US006206243B1

(12) United States Patent
Schneider et al.

(10) Patent No.: US 6,206,243 B1
(45) Date of Patent: Mar. 27, 2001

(54) COLLAPSIBLE SPRAY BOTTLE

(75) Inventors: Paul A. Schneider, Waunakee; Mark A. McLean, Fitchburg, both of WI (US)

(73) Assignee: Alterra Holdings Corporation, Portland, OR (US)

( * ) Notice: Subject to any disclaimer, the term of this patent is extended or adjusted under 35 U.S.C. 154(b) by 0 days.

(21) Appl. No.: 09/329,174

(22) Filed: Jun. 9, 1999

(51) Int. Cl.[7] ..... B65D 35/28
(52) U.S. Cl. ..... 222/95; 222/211; 222/383.1
(58) Field of Search ..... 222/95, 211, 383.1

(56) References Cited

U.S. PATENT DOCUMENTS

| | | | |
|---|---|---|---|
| D. 247,302 | 2/1978 | Federico et al. | D23/18 |
| D. 293,017 | 12/1987 | Janowitz | D23/212 |
| D. 311,861 | 11/1990 | Vanhoutte | D9/300 |
| D. 329,802 | 9/1992 | Foster et al. | D9/300 |
| D. 333,609 | 3/1993 | Beaumont | D9/300 |
| D. 347,788 | 6/1994 | Steijns et al. | D9/300 |
| D. 349,642 | 8/1994 | Abfier | D9/300 |
| D. 353,321 | 12/1994 | Steijns et al. | D9/300 |
| D. 365,980 | 1/1996 | Matara et al. | D9/300 |
| 1,293,860 | 2/1919 | Mock . | |
| 1,596,355 | 8/1926 | Hirsch . | |
| 1,623,107 | 4/1927 | Goodykoontz . | |
| 3,083,877 | 4/1963 | Gash | 222/107 |
| 3,137,419 | 6/1964 | Davy | 222/527 |
| 3,165,114 | 1/1965 | Garrett | 137/268 |
| 3,638,834 | 2/1972 | Goodrich et al. | 222/105 |
| 4,705,191 | 11/1987 | Itzel et al. | 222/80 |
| 4,911,562 | 3/1990 | Mazzeschi | 383/16 |
| 5,031,798 | 7/1991 | Wild | 222/82 |
| 5,056,685 | 10/1991 | Wild | 222/82 |
| 5,174,458 * | 12/1992 | Segati | 222/95 |
| 5,462,209 | 10/1995 | Foster et al. | 222/370 |
| 5,638,994 * | 6/1997 | Libit et al. | 222/211 |
| 5,647,511 | 7/1997 | Bond | 222/105 |
| 5,667,101 | 9/1997 | Barrash et al. | 222/92 |
| 5,897,032 * | 4/1999 | Ellion et al. | 222/211 |
| 5,954,230 * | 9/1999 | Blette et al. | 222/95 |
| 5,979,715 * | 11/1999 | Emrick | 222/211 |

FOREIGN PATENT DOCUMENTS

| | | | |
|---|---|---|---|
| 336415 * | 10/1989 | (EP) | 222/383.1 |

* cited by examiner

*Primary Examiner*—Joseph A. Kaufman
(74) *Attorney, Agent, or Firm*—Foley & Lardner

(57) ABSTRACT

A spray bottle for holding and dispensing a liquid comprises a collapsible container for holding the liquid, a spray head for dispensing and atomizing the liquid, and an elongated coupling for securing the spray head to the container and providing a handhold. The container is adapted to be collapsed into a substantially flat panel when empty and to be distended when the bottle is filled with the liquid. With the spray bottles empty and the containers collapsed, a retail display may comprise a plurality of spray bottles. The spray bottles are arranged in at least one row with the containers collapsed such that each spray head is in an abutting relationship with the spray head of at least one adjacent spray bottle.

48 Claims, 13 Drawing Sheets

COLLAPSIBLE SPRAY BOTTLE

FIELD OF THE INVENTION

The present invention relates to a novel spray bottle and, more particularly, to a spray bottle including a collapsible container for holding a liquid and a hand operated pump for dispensing and atomizing the liquid.

BACKGROUND OF THE INVENTION

Numerous embodiments of manually operated spray bottles are well known in the art. Such spray bottles are used for a wide variety of applications such as applying water, detergents, herbicides, pesticides, fertilizers and other materials to designated areas. Typically, the spray bottles can be operated to produce different spray patterns ranging from a fine mist to a concentrated stream. Most such spray bottles comprise a container for holding a liquid and a spray head or hand operated pump connected to the container for dispensing the liquid. Numerous manually operated spray heads are known in the art, representative examples of which are disclosed in U.S. Pat. No. 3,061,202 to Tyler, U.S. Pat. No. 3,129,856 to Boris, U.S. Pat. No. 3,701,478 to Tada, U.S. Pat. No. 3,998,363 to Beres et al., U.S. Pat. No. 4,819,835 to Tasaki, U.S. Pat. No. 4,489,890 to Martin, and U.S. Pat. No. 5,205,442 to Harris et al., the disclosures of which are hereby incorporated by reference as though fully set forth herein.

Containers for such spray bottles are also well known. At the present time, most such containers are molded from plastic materials that are substantially rigid after manufacture. As such containers are often designed to hold a substantial volume of liquid, the resulting space requirements and difficulties in handling such containers can complicate transportation and retail display of the spray bottles and thereby increase product costs to the consumer.

The transportation and retail display associated with such spray bottles would be greatly reduced if the volume of such containers could be reduced without affecting the carrying capacity of the containers.

SUMMARY OF THE INVENTION

The present invention provides a spray bottle for holding and dispensing a liquid. The spray bottle comprises a collapsible container for holding the liquid and a spray head connected to the container for dispensing and atomizing the liquid. The container is adapted to be collapsed into a substantially flat panel when empty and to be distended when the bottle is filled with the liquid.

In accordance with a preferred aspect of the invention, the spray bottle further comprises an elongated coupling intermediate the container and the spray head. The coupling is substantially rigid and may be adapted to provide a handhold. The coupling is preferably removably secured to both the spray head and the container.

The invention further provides for a retail display comprising a plurality of spray bottles. Each spray bottle includes a collapsible container for holding a liquid and a spray head connected to the container. The container is adapted to be collapsed into a substantially flat panel when empty and to be distended when the bottle is filled with the liquid. The spray head is adapted for dispensing and atomizing the liquid. The plurality of spray bottles may be arranged in at least one row with the containers collapsed such that each spray head is in an abutting relationship with the spray head of at least one adjacent spray bottle.

These and other benefits and features of the present invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENTS

Figure 1:
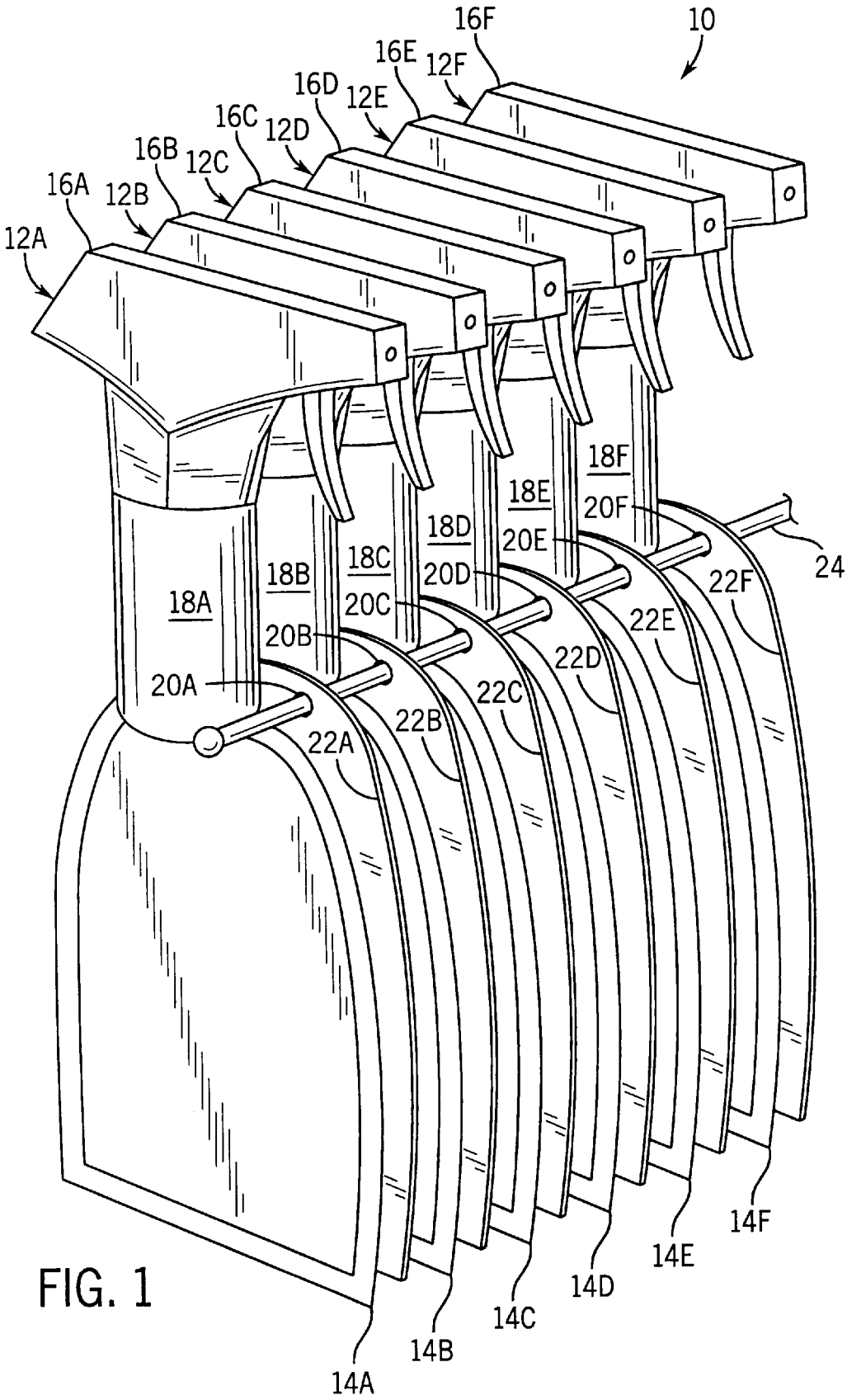
FIG. 1 is perspective view of a retail display including a plurality of collapsible spray bottles in accordance with a first embodiment of the present invention.

Turning first to FIG. 1, an in-store retail display 10 is shown to include a plurality of spray bottles 12A–12F. Each spray bottle 12A–12F includes an associated collapsible container (or pouch) 14A–14F for holding a liquid and a manually-operated spray head 16A–16F for dispensing and atomizing the liquid. As illustrated, each spray head 16A–16F is of the trigger sprayer type and is connected to its associated container 14A–14F by an elongated coupling (or extension tube) 18A–18F, which also provides a handhold.

Figure 6B:
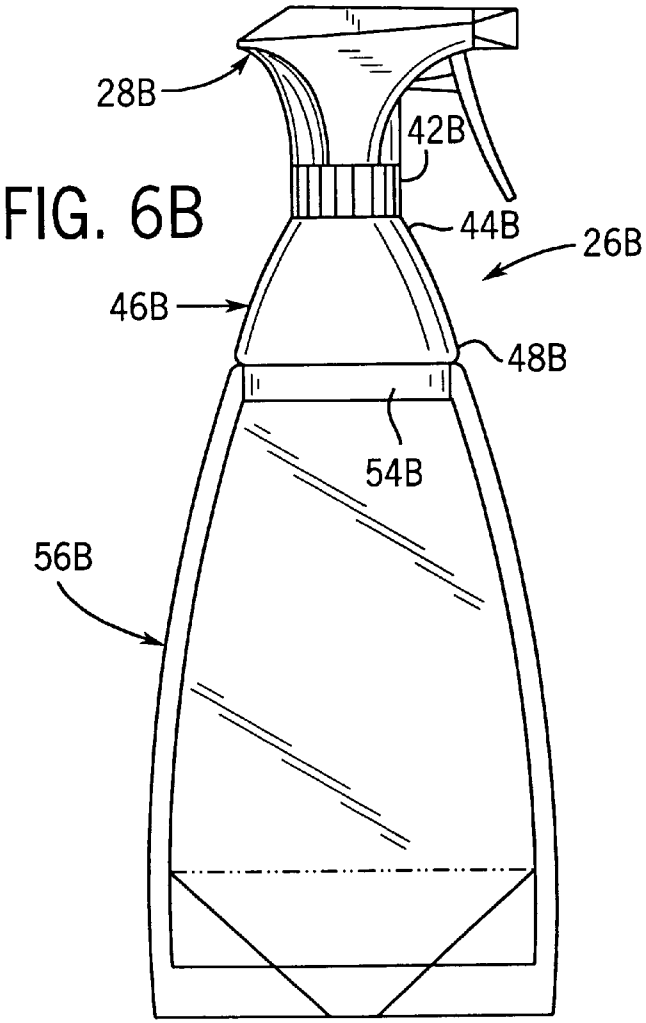
FIGS. 6A–6P are elevation views of alternative embodiments of collapsible spray bottles in accordance with the present invention.
Figure 6A:
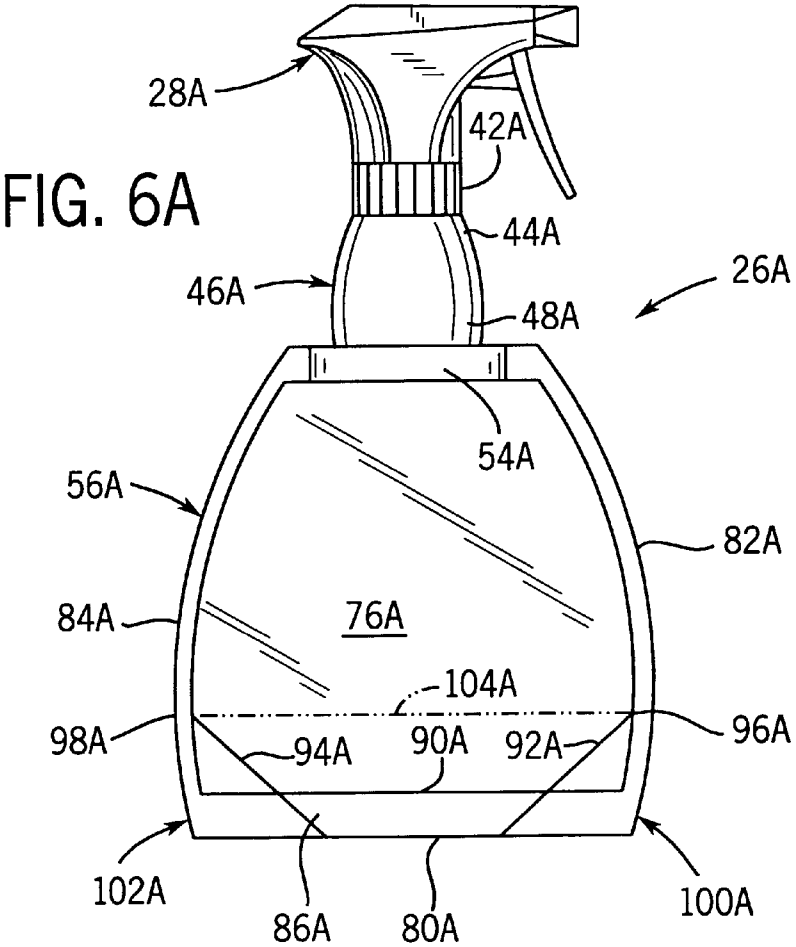
Figure 6D:
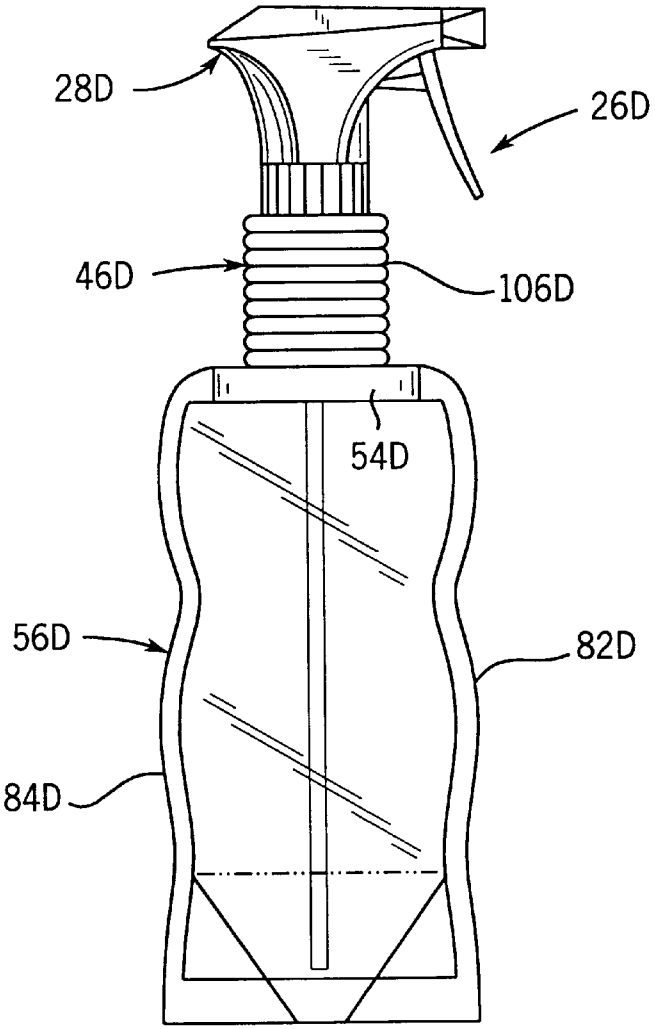
Figure 6C:
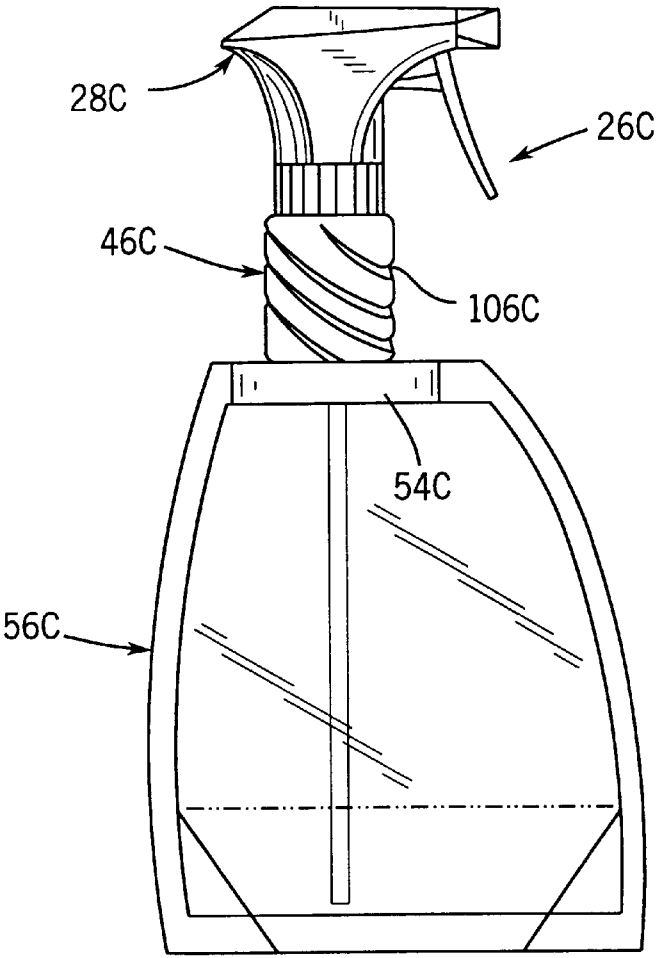
Figure 6F:
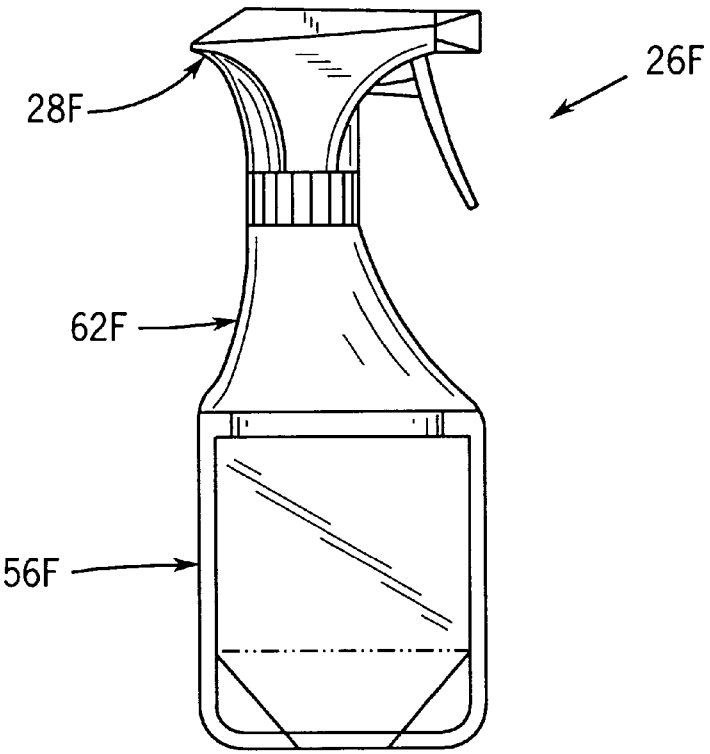
Figure 6E:
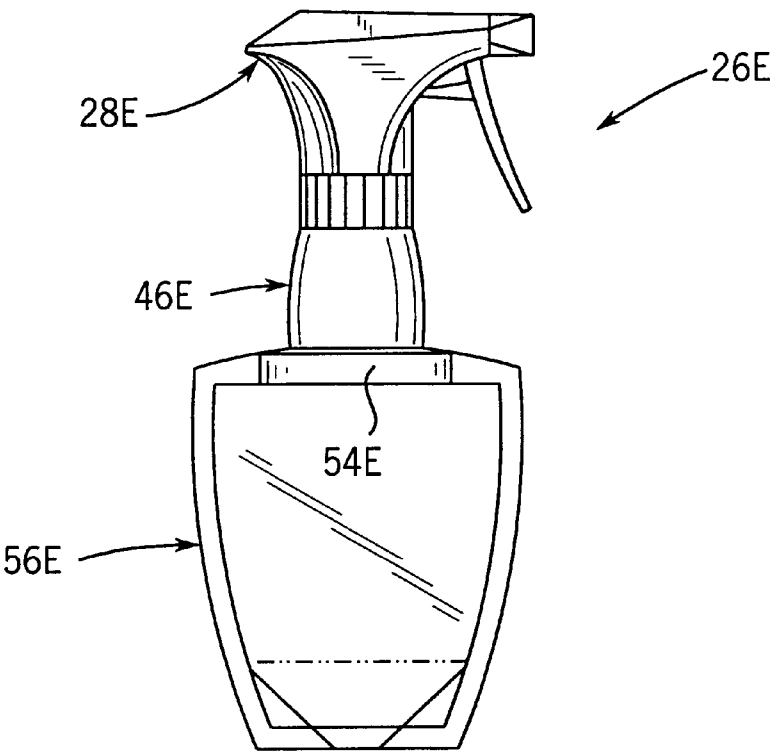
Figure 6H:
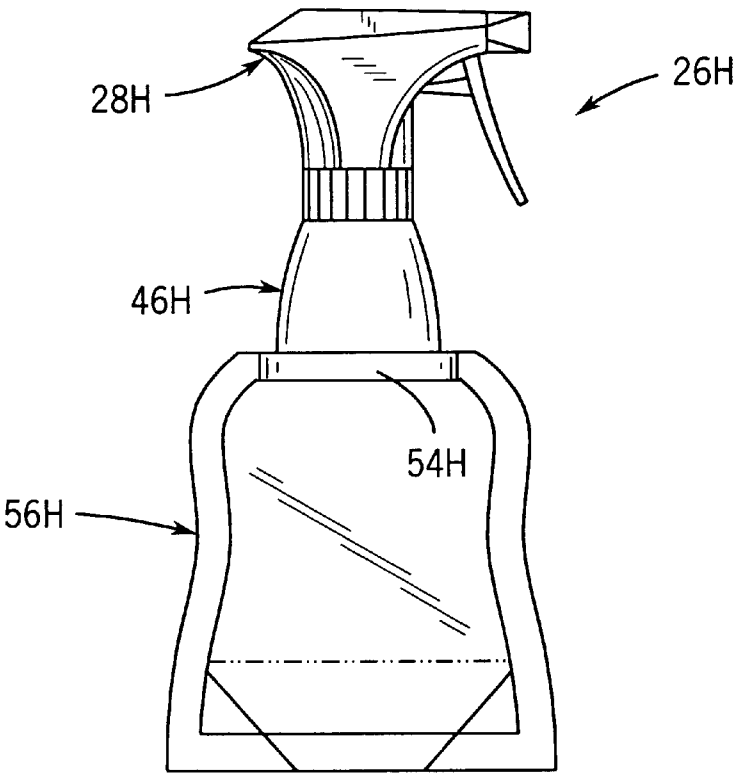
Figure 6G:
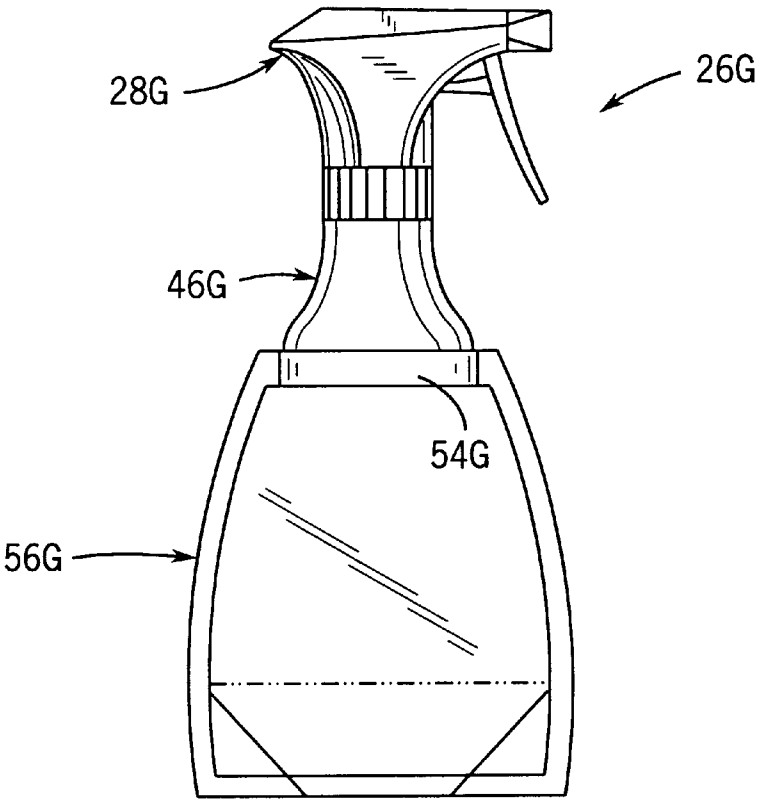
Figure 6J:
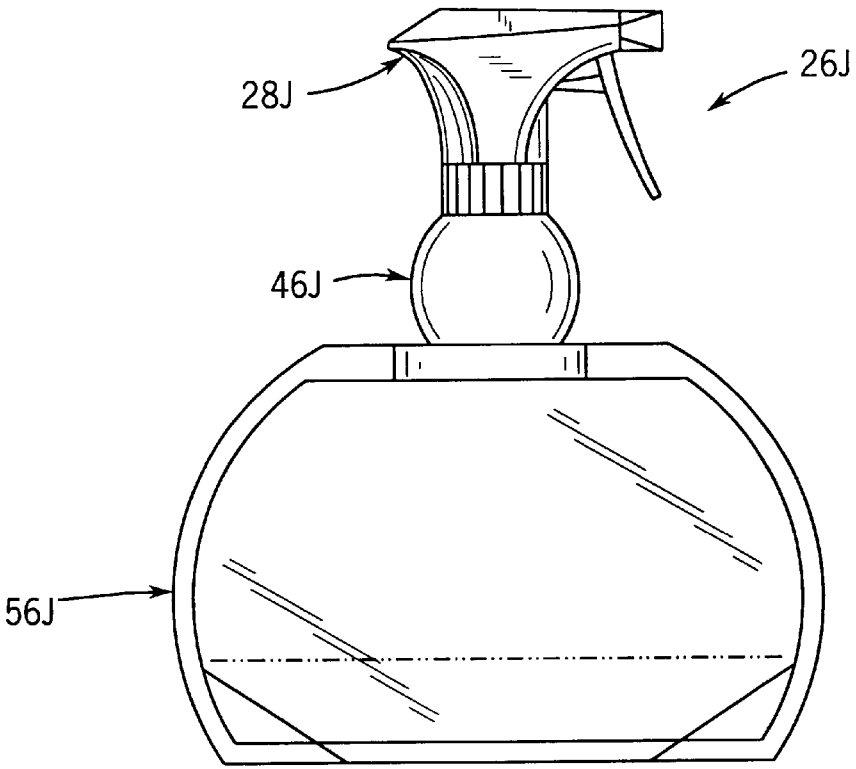
Figure 6I:
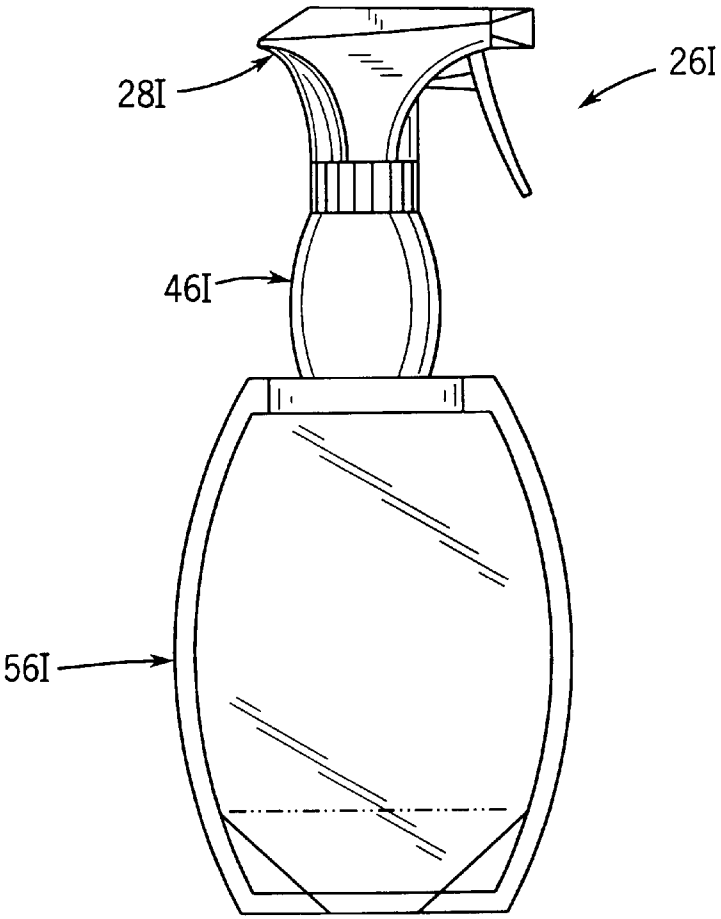
Figure 6L:
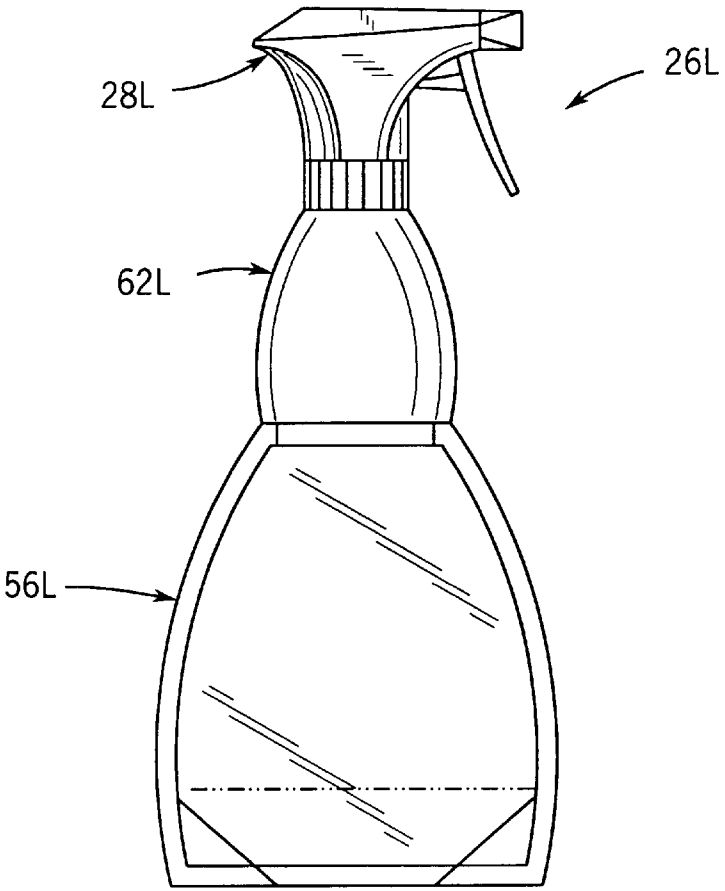
Figure 6K:
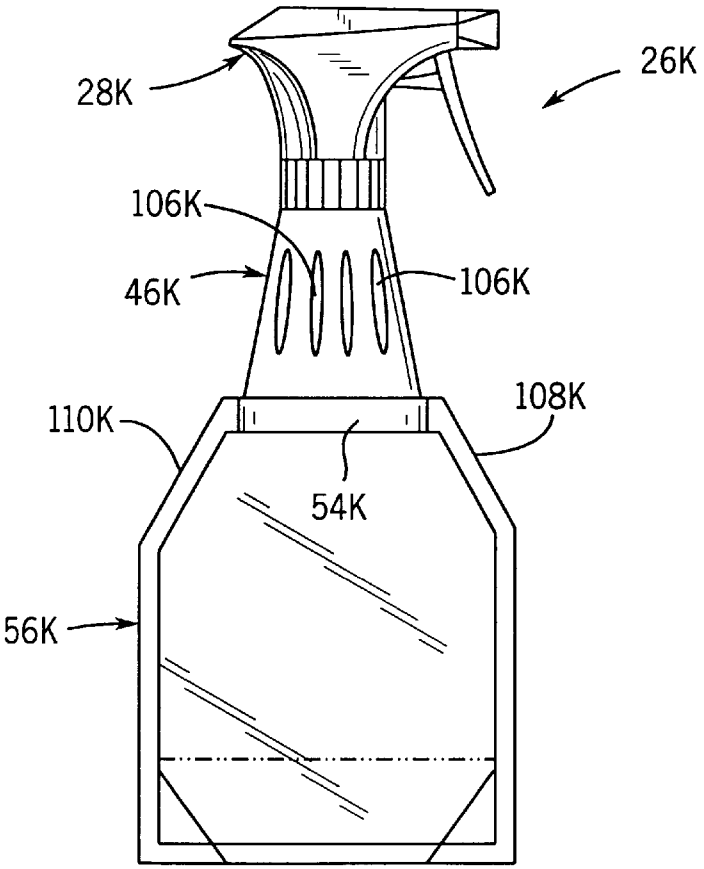
Figure 6N:
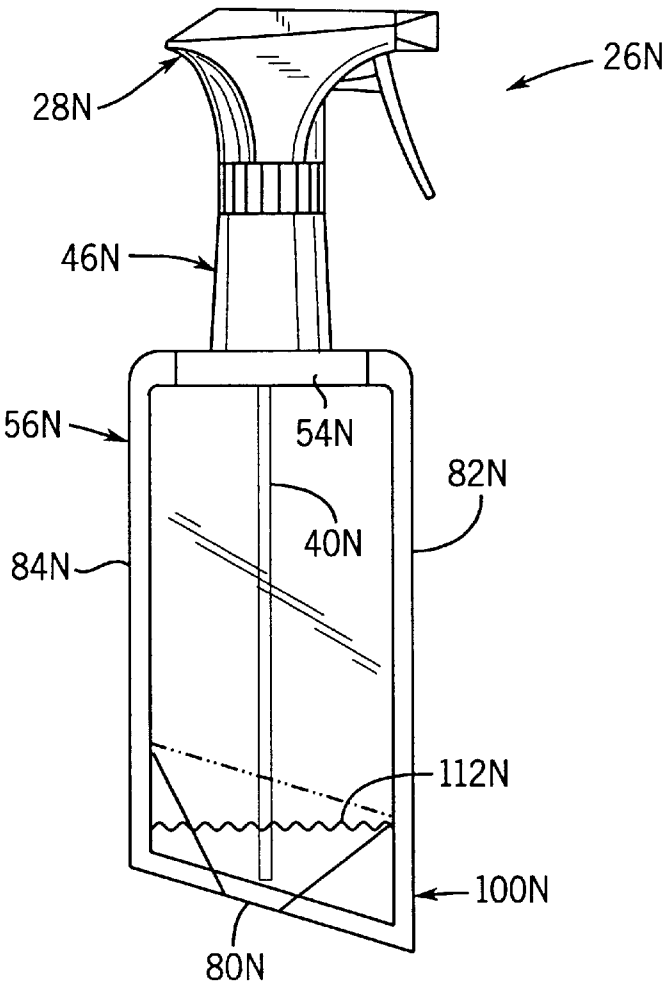
Figure 6M:
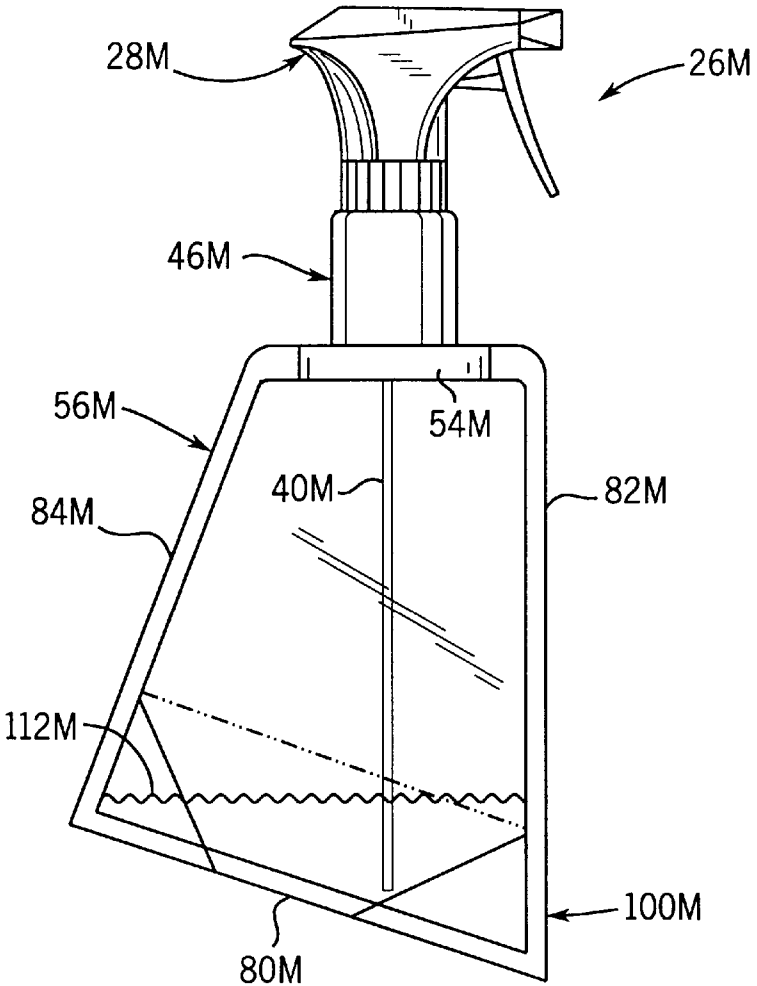
Figure 6P:
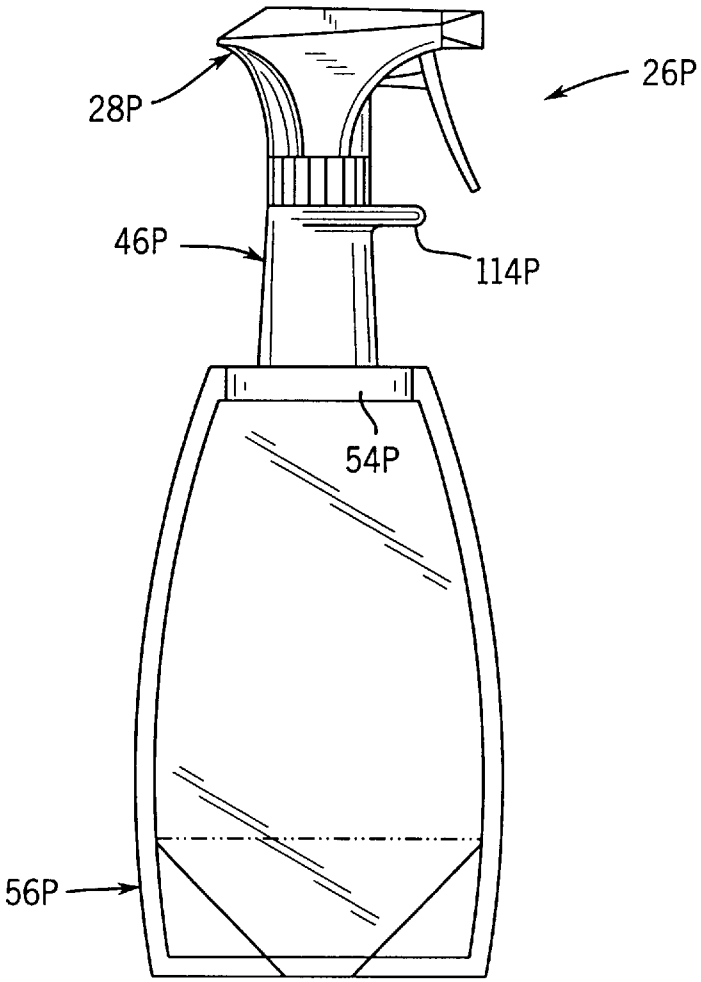

As explained in detail below, each container 14A–14F is adapted to be collapsed (as shown in FIG. 1) into a substantially flat panel when empty, and to be distended (as shown in FIGS. 6A–6P) when container 14A–14F is filled with the liquid. When containers 14A–14F are collapsed into the flat panels, the plurality of spray bottles 12A–12F can be advantageously hung in a compact side-by-side arrangement wherein each spray head 16A–16F is in an abutting relationship with (or closely adjacent) the spray head of at least one adjacent spray bottle 12A–12F in the display 10 (see FIG. 1). That is, unlike with conventional spray bottles in which the number of bottles in a given display area are typically limited by the widths of the containers, by using the present collapsible spray bottles 12A–12F the number bottles in the display area is limited only by the widths of the relatively narrow spray heads 16A–16F. Another retail display advantage of using collapsible containers 14A–14F for retail display purposes is that each container 14A–14F can be easily provided with a product display aperture (or delta hole) 20A–20F in one of its peripheral edges 22A–22F, which may be used to hang spray bottle 12A–12F on a display rod 24. This arrangement eliminates the need for separate packaging materials, such as a product card or fact card (not shown). In addition, each container 14A–14F may be provided with visual features for advertising or information purposes such as fashion elements, labels, printing, and the like, which also can eliminate the need for separate packaging materials.

Figure 2:
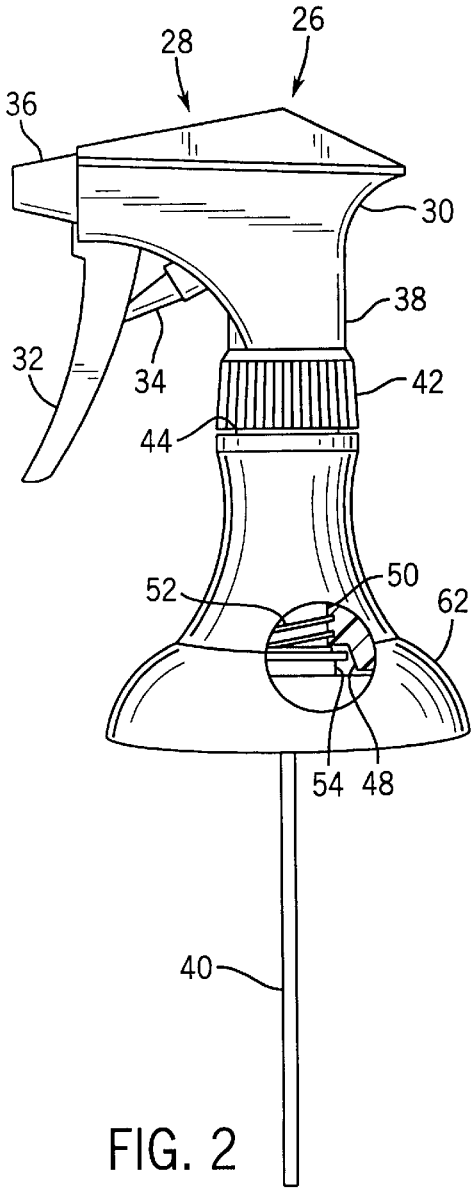
FIG. 2 is an elevation view of the top portion of a collapsible spray bottle in accordance with a second embodiment of the present invention.
Figure 3:
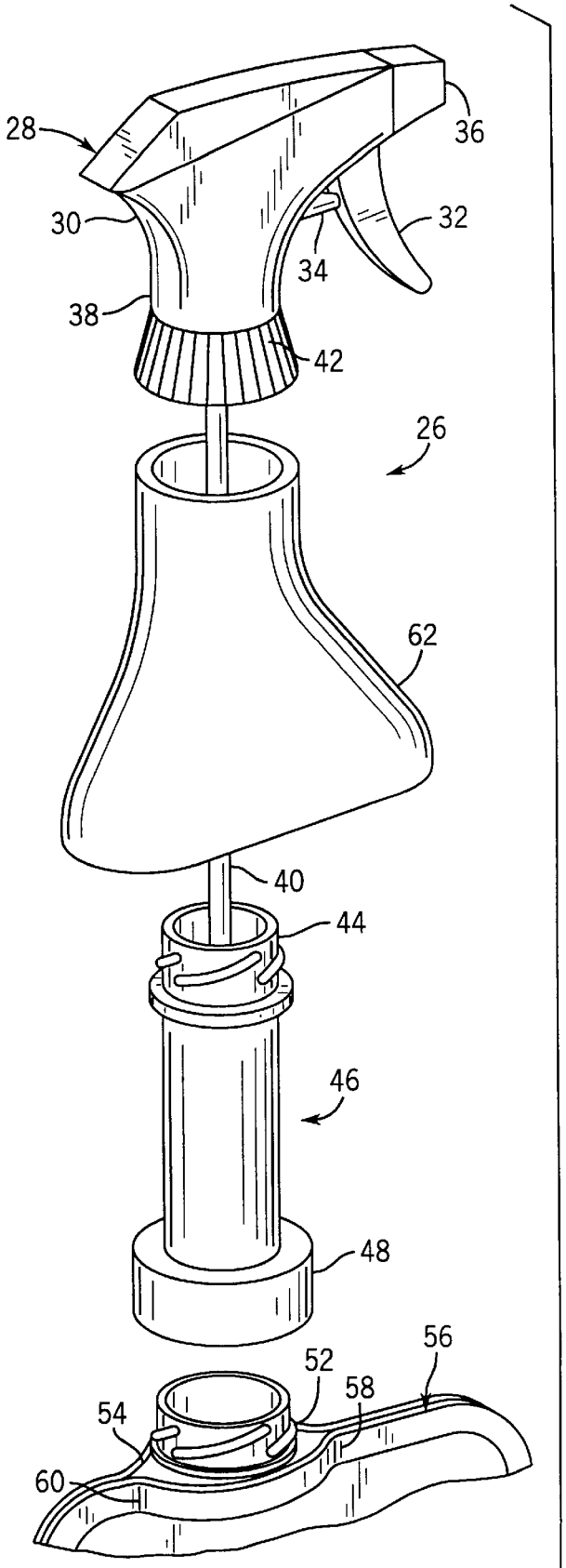
FIG. 3 is an exploded perspective view of the top portion of the spray bottle of FIG. 2.

Turning now to FIGS. 2 and 3, an upper portion of another embodiment of a spray bottle 26 can be seen to include a manually operated pump or spray head 28. Spray head 28 is preferably a trigger sprayer that is conventional in the art, and thus only a general description of spray head 28 will be described below. Additional details of such a trigger sprayer are disclosed in U.S. Pat. No. 4,489,890 to Martin, the entire disclosure of which is hereby incorporated by reference as though fully set forth herein.

As is conventional, spray head 28 includes a body 30, a trigger 32, a piston 34, a nozzle assembly 36 for controlling the output of the liquid, a stem 38, and a feed tube 40. Trigger 32 is pivotally attached to body 30 and operates on piston 34 against the outward bias provided by a piston spring (not shown). Stem 38 includes a rotatable securing ring 42 having internal (i.e., female) threads for securing spray head 28 to external (i.e., male) threads of an upper end 44 of an coupling or extension tube 46. By providing the female threads in the securing ring 42 which is freely rotatable on stem 38, spray head 28 can be easily held in any orientation that is desired by the user.

Extension tube 46 includes a downwardly facing collar 48 having internal threads 50 configured for threaded engagement with external threads 52 of a fitting 54 embedded in a collapsible container 56. As best seen in FIG. 3, fitting 54 is somewhat elliptical or canoe shaped when viewed from above (i.e., it includes opposed pointed ends 58 and 60). The elliptical shape of fitting 54 allows it to be more securely fastened to the film material of container 56 by increasing the contact area and eliminating abrupt transitions in the film material. While securing ring 42 is preferably threaded to extension tube 46 (which in turn in threaded to fitting 54), securing ring 42 could instead be threaded directly to fitting 54 so long as stem 38 is of a sufficiently elongated shape to provide room for a user's hand between body 30 of spray head 28 and container 56. It should also be noted that although the releasable engagement between the various components is preferably by screw threads, alternative engagement features could be employed.

As illustrated, spray bottle 26 includes an optional decorative cover 62. Cover 62 may be configured to enhance the visual appearance of spray bottle 26 and/or to provide a more comfortable handhold for the user. As can be seen, cover 62 is configured to surround extension tube 46 and to extend downwardly from the lower edge of securing ring 42 to partially overlie an upper region of container 56. It should be noted that since cover 62 is separate from extension tube 46, cover 62 can be readily aligned in any orientation relative to container 56 desired by the user.

Figure 4A:
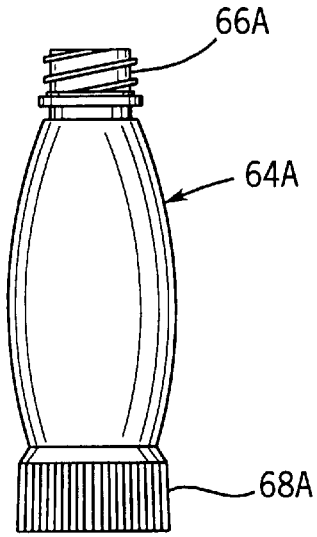
FIGS. 4A–4C are elevation views of alternative embodiments of couplings for connecting a spray head to a collapsible container.
Figure 4B:
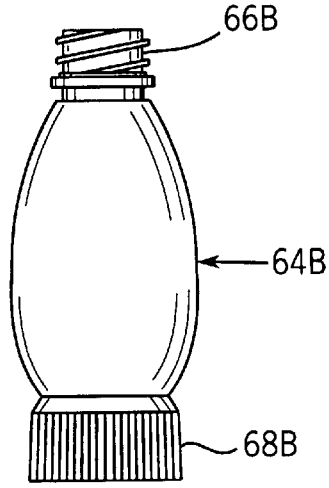
Figure 4C:
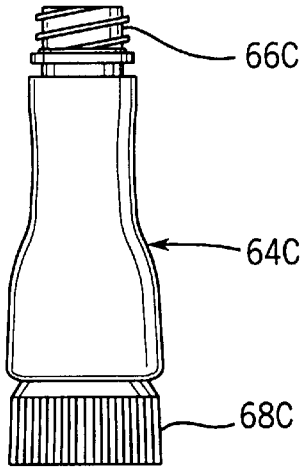

Referring now to FIGS. 4A–4C, three different constructions of couplings 64A, 64B and 64C can be seen. It will be understood that couplings 64A, 64B and 64C are merely exemplary of the many possible constructions, and that a wide variety of shapes and sizes could be utilized. In general, however, each coupling 64A, 64B and 64C will have an elongated shape to provide sufficient spacing between the spray head and the container for accommodating the user's hand. In addition, each coupling 64A, 64B and 64C will be made of a substantially rigid material (e.g., PVC or other plastic material) to provide the user with a rigid handhold. Each coupling 64A, 64B and 64C is also of generally tubular construction to allow passage of the feed tube from the spray head to the container. Preferably, each coupling 64A, 64B and 64C includes a male-threaded upper end 66A, 66B and 66C, respectively, and a female-threaded lower end 68A, 68B and 68C, respectively. In addition, each coupling 64A, 64B and 64C preferably has a sufficiently pleasing exterior surface that a separate decorative cover is not required, thus decreasing manufacturing costs by reducing raw materials, parts, and assembly steps.

Figure 5:
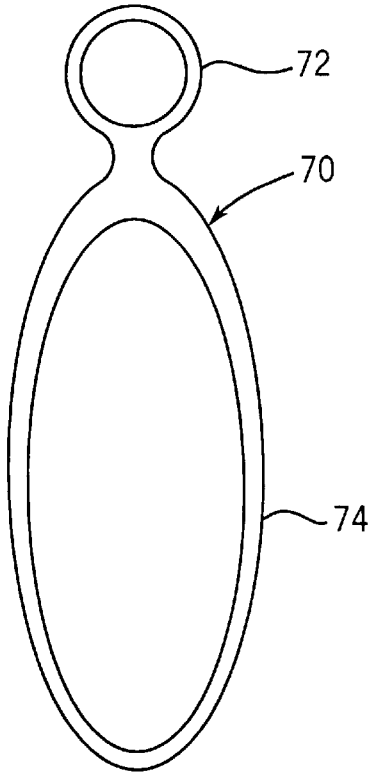
FIG. 5 is a schematic representation of a wrist strap for use in combination with the present invention.

Turning now to FIG. 5, an optional wrist strap 70 is schematically shown to include a small loop 72 and a large loop 74 secured together. Small loop 72 is preferably configured to fit over the upper end 66A, 66B, 66C of one of the couplings 64A, 64B, 64C, and large loop 74 is sized to be worn on the wrist of the user. Wrist strap 70 is preferably formed of a resilient rubber or plastic material that allows loop 74 to be stretched over the hand of the user and then return to shape.

Turning now to FIGS. 6A–6P, a number of additional alternative embodiments of the collapsible spray bottles will be described. As the collapsible spray bottles illustrated in FIGS. 6A–6P are in most respects similar to spray bottles 12A–12F and 26 described above (see FIGS. 1–3), the descriptions thereof will be generally limited to the extent that they differ from those earlier embodiments. In the following descriptions, for brevity the various components of the spray bottles shown in FIGS. 6A–6P similar to like components in spray bottle 26 shown in FIGS. 2 and 3 will be identified by identical reference numerals but appended with the appropriate alphabetic designation (A–P).

With brief reference to all the FIGS. 6A–6P, each spray bottle 26A–26P can be seen to include an associated spray head 28A–28P of the trigger sprayer type, a collapsible container 56A–56P of generally rectangular construction, and a coupling 46A–46P intermediate the associated spray head and container. In addition, each coupling 46A–46P has an upper end 44A–44P threadedly engaged with a securing ring 42A–42P of the associated spray head 28A–28P, and a lower end 48A–48P threadedly engaged with a canoe fitting 54A–54P of the associated container 56A–56P. As illustrated, each container 56A–56P is in a substantially expanded condition, i.e., as if filled with a liquid.

With reference to FIG. 6A, the preferred construction of one collapsible container 56A will now be described. The remaining collapsible containers 56B–56P are of generally similar construction except as specifically noted otherwise below. Container 56A preferably comprises three separate sheets of material secured together to form a right-side wall 76A, a left-side wall (not visible), and a bottom wall 80A. As can be seen, right-side wall 76A and left-side wall 78A are joined together along a front peripheral edge 82A and a rear peripheral edge 84A of container 56A. In addition, right-side wall 76A and bottom wall 80A are joined together along a right-side bottom peripheral edge 86A, while left-side wall 78A and bottom wall 80A are joined together along a left-side bottom peripheral edge (not visible). It should be understood that when container 56A is filled with liquid and in the expanded condition (as shown), side walls 76A and 78A will bow outwardly relative to each other and bottom wall 80A will assume a position in which a central portion 90A extends substantially perpendicular to side walls 76A and 78A. At the same time, front and rear portions 92A and 94A of bottom wall 80A each assume a position at an angle relative to the horizontal central portion 90A. More particularly, front and rear portions 92A and 94A assume inverted V-shapes and extend upwardly and outwardly from opposite ends of central portion 90A to intersections 96A and 98A with front and rear peripheral edges 82A and 84A, respectively. With the foregoing construction, container 56A can be seen to include a pair of gussets 100A and 102A at its bottom region which allow the bottom region to more fully expand and thereby increase the capacity of container 56A. Preferably, gussets 100A and 102A allow the bottom region to expand sufficiently that container 56A becomes self supporting when full, that is, container 56A when filled with liquid and placed on a horizontal surface is capable of standing upright all by itself just as if it were of rigid construction instead of collapsible.

Gussets 100A and 102A also permit container 56A to be fully collapsed when empty. In particular, container 56A can be collapsed by tucking a central portion 90A of bottom wall 80A up between lower regions of side walls 76A and 78A, i.e., bottom wall 80 is folded or doubled back upon itself. This folded position of bottom wall 80A is represented by a dashed line 104A in FIG. 6A, i.e., line 104A shows the uppermost position occupied by bottom wall 80A when bottom wall 80A is doubled back upon itself and container 56A is folded. Thus, gussets 100A and 102A are adapted to fold when container 56A is empty to permit it to collapse into the flat panel, and gussets 100A and 102A also unfold when container 56A is filled with the liquid to permit it to fully distend. Those skilled in the art will understand that other constructions besides gussets could be used to provide a container collapsing to a substantially flat panel, such as an accordion type construction. Preferably, any such construction should allow the container to collapse sufficiently that the width of the container (i.e., the maximum distance between right-side wall 76A and left side wall 78A) is less than the width of the spray head, and to expand sufficiently that the width of the container is greater than the width of the spray head.

Peripheral edges 82A, 84A, 86A and 88A are preferably formed by heat staking (or heat welding) the overlapping marginal edges of the three sheets together in the illustrated arrangement. In addition, canoe fitting 54A is preferably secured to right-side wall 76A and left-side wall 78A by heat staking (or heat welding). Those skilled in the art will understand, however, that numerous other methods besides heat staking could be used to form the peripheral edges and/or secure the fitting.

Container 56A is preferably made from a plastic film or a laminate material, which may comprise or include a printed film. In addition, container 56A may be provided with a fashion element, a label, and/or printing. Fitting 54A is preferably made from an injection molded plastic, but it may be made from any suitable material capable of being joined to the sheet material. Containers of the foregoing type can be manufactured by and are commercially available from a number of companies, including Riley & Geehr Flexible Packaging Specialists, of Evanston Ill.

Now that spray bottle 26A has been fully described, some brief comments will be made as to the primary differences illustrated in the remaining spray bottles 26B–26P (see FIGS. 6B–6P). FIG. 6B shows a spray bottle 26B having a larger diameter fitting 54B on container 56B than fitting 54A seen in FIG. 6A. In addition, coupling 46B is substantially more cone-shaped than the couplings previously seen, and it also provides a smoother transition with container 56B.

FIGS. 6C and 6D show spray bottles 26C and 26D which differ from the previously seen embodiments primarily in that the associated couplings 46C and 46D are provided with relief patterns 106C and 106D, respectively. Relief patterns 106C and 106D can be used to enhance the visual appeal of couplings 46C and 46D and/or to facilitate the user's grip. Container 56D is illustrated with wavy front and rear peripheral edges 82D and 84D, which is representative of the fact that the collapsible containers can be made in an almost limitless variety of shapes.

FIG. 6E shows a spray bottle 26E in which an associated container 56E has a top region that is wider than its bottom region. FIG. 6F shows a spray bottle 26F including a generally square-sided container 56F, and a decorative (or two-piece) cover 62F extends over the coupling (not visible). As can be seen, decorative cover 62F need not be symmetrical (e.g., round or elliptical in horizontal cross-section) because, as noted above, it is separate from the coupling and thus can be easily rotated into the desired orientation with respect to container 56F.

FIGS. 6G and 6H show spray bottles 26G and 26H which are substantially similar to the foregoing embodiments, except that each container 56G and 56H has a large diameter fitting 54G and 54H, respectively, similar to fitting 54B on container 56B (see FIG. 6B).

FIGS. 6I and 6J show collapsible spray bottles 26I and 26J with couplings 46I and 46J and associated containers 56I and 56J that are more rounded than the like components in the embodiments previously seen. In addition, couplings 46I and 46J are substantially more similar in shape to their associated containers 56I and 56J than is seen in the foregoing embodiments.

FIGS. 6K and 6L show two further embodiments of spray bottles 26K and 26L. As can be seen, container 56K has upper peripheral edges 108K and 110K that converge toward fitting 54K, which is of the large diameter type. Also as seen, coupling 46K includes a vertically extending relief pattern 106K. Spray bottle 26L includes a decorative cover 62L, which has a shape that closely approximates the shape of its associated container 56L.

Figure 6O:
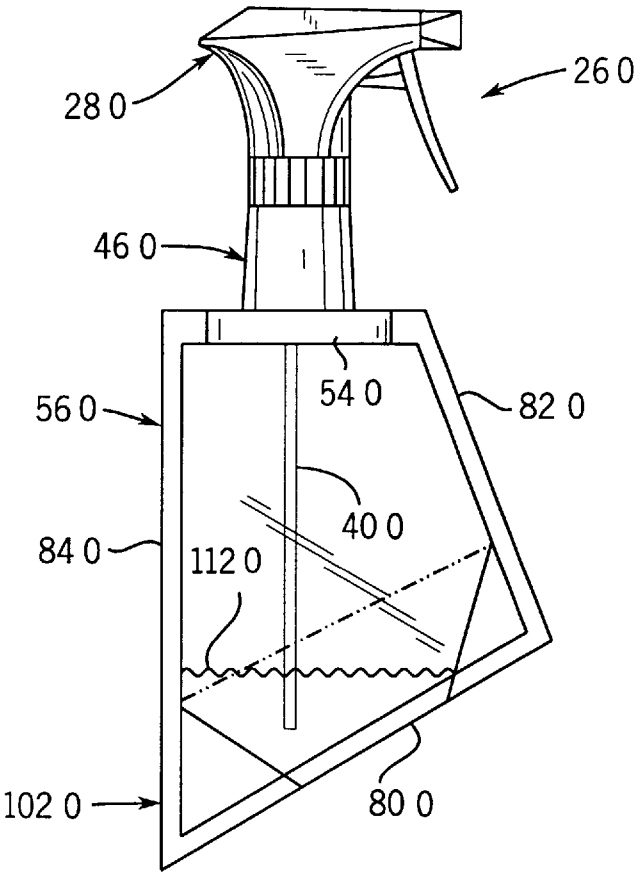

FIGS. 6M–6O show spray bottles 26M, 26N and 26O, in which the associated bottom walls 80M, 80N and 80O each assume an angle relative to the horizontal when spray bottles 26M, 26N and 26O are held upright for spraying. That is, bottom walls 80M, 80N, and 80O are set at an angle to the front and rear peripheral edges (82M, 84M), (82N, 84N), and (82O, 84O), respectively, rather than substantially perpendicular to those edges as in the previous embodiments. With this construction, an upper surface 112M, 112N, 112O of the liquid in each container 56M, 56N, 56O assumes an angle relative to bottom walls 80M, 80N, 80O when spraying, which allows a more complete spray out of the liquid from the container. Preferably, each bottom wall 80M, 80N and 80O is angled such that the associated feed tube 40M, 40N and 40O terminates at a bottom region of container 56M, 56N and 56O adjacent the intersection of one lower gusset 100M, 100N and 102O and bottom central portion 90M, 90N and 90O, which forms a low point in the container.

FIG. 6P shows a spray bottle 26P which is notable in that it includes a secondary support 114P designed to carry weight on the user's ring finger. Additional or alternative ergonomic designs or finger holds/grips could easily be employed.

Figure 7A:
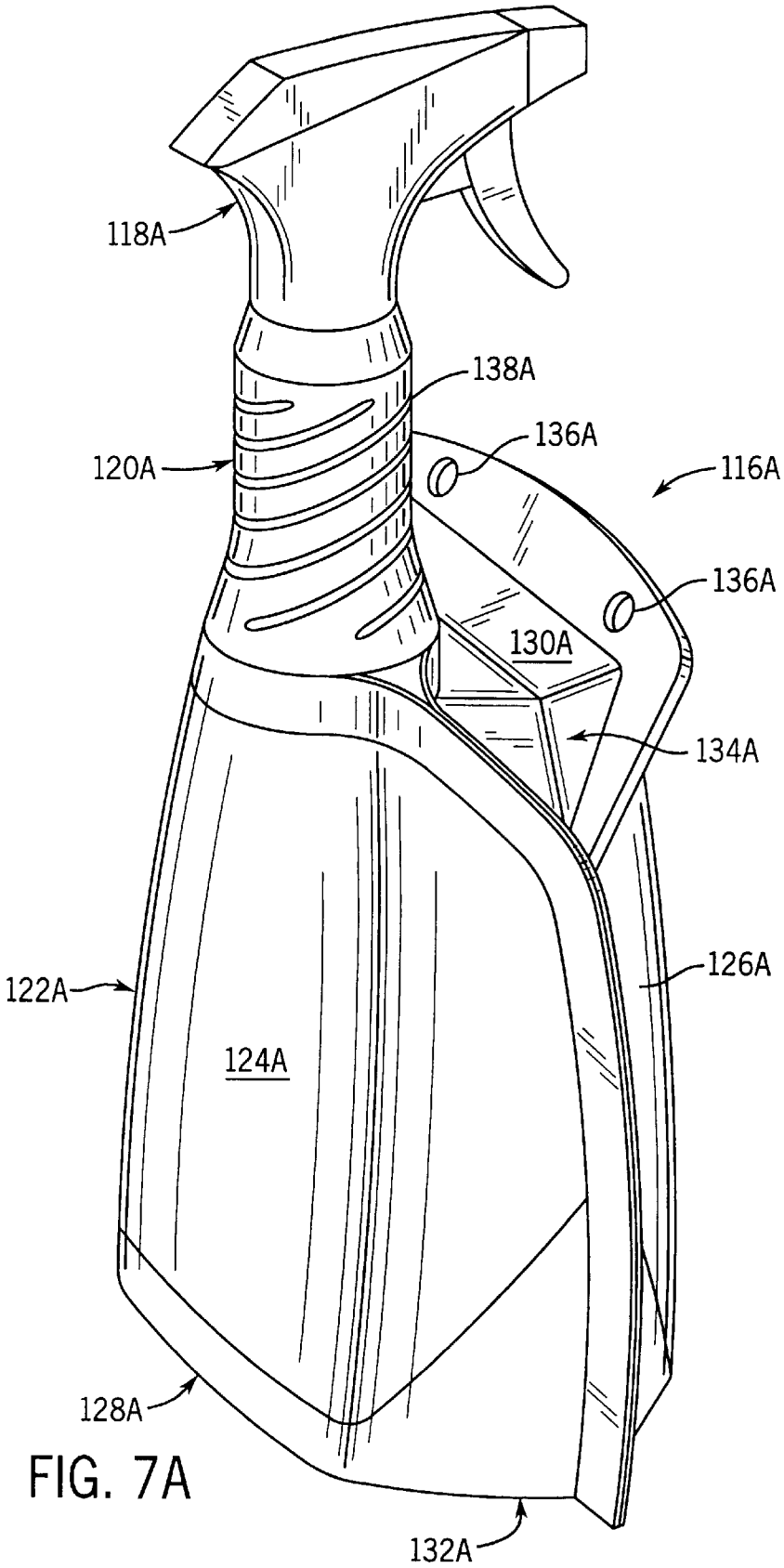
FIGS. 7A and 7B are perspective views of alternative embodiments of collapsible spray bottles in accordance with the present invention.
Figure 7B:
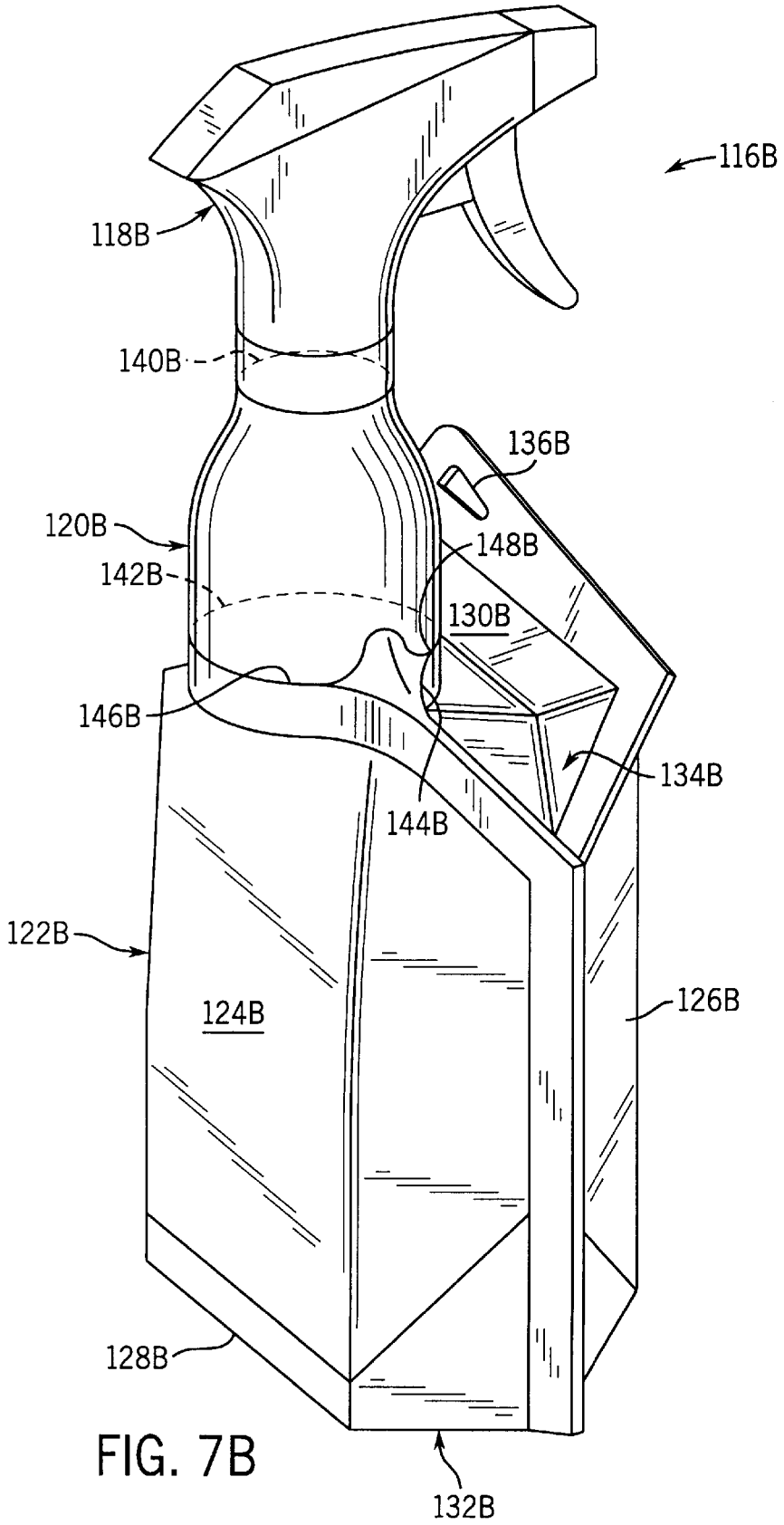

Turning now to FIGS. 7A and 7B, two final embodiments of spray bottles 116A and 116B will be described. Spray bottles 116A and 116B are for the most part similar to the above described spray bottles, except as otherwise described below.

Referring first to the primary features shared in common by spray bottles 116A and 116B, each can be seen to include a spray head 118A and 118B, a coupling 120A and 120B, and a collapsible container 122A and 122B. In addition, each container 122A and 122B can be seen to include a right-side wall 124A and 124B, a left-side wall 126A and 126B, a bottom wall 128A and 128B (not visible), and a top wall 130A and 130B. Thus, unlike the previously described embodiments, each container 122A and 122B is preferably formed from four separate sheets of material rather than three sheets (i.e., one additional sheet is used to form the top wall). Although containers 122A and 122B each include gussets 132A and 132B in the bottom region (like all the prior embodiments), unlike the prior embodiments each container 122A and 122B also includes gussets 134A and 134B, respectively, in a top region. With this construction, containers 122A and 122B are capable of substantial expansion at their upper ends as well as their bottom ends. Another feature shared in common between containers 122A and 122B is that each is provided with at least one delta hole 136A and 136B for retail display purposes.

Turning now to the primary features that differ between spray bottles 116A and 116B, coupling 120A can be seen to include a relief pattern 138A which provides a textured handhold, while the exterior surface of coupling 120B is smooth. Another notable difference is that while coupling 120A has a circular horizontal cross-section throughout its entire length, coupling 120B has a circular horizontal cross-section 140B at its top end but then transitions to an elliptical horizontal cross-section 142B at its lower end. With coupling 120B having an elliptical shape at its lower end, it is no longer possible to provide it with threads and secure it to a fitting on container 122B. Instead, the lower end of coupling 120B transitions from the elliptical horizontal cross-section 142B to a canoe crosssection 144B, which can then be heat staked between a top peripheral edge 146B of left-side wall 126B and a left-side peripheral edge 148B of top wall 130B.

Numerous characteristics, advantages, and embodiments of the invention have been described in detail in the foregoing description with reference to the accompanying drawings. However, the disclosure is illustrative only and the invention is not limited to the precise illustrated and described embodiments. For example, although the collapsible containers are preferably made by heat staking separate sheets of material together, the containers could be made from a single sheet of material wrapped back upon itself and/or by using an adhesive to secure the separate sheets. Moreover, the collapsible container could even be a seamless construction if made by a technique such as blow molding. In addition, although all the spray heads are illustrated as trigger type sprayers, other types of manually operated spray heads or pumps capable of dispensing and atomizing liquid could be used. These and other changes and modifications may be effected by one skilled in the art without departing from the scope or spirit of the present invention, which is limited only by the scope of the claims which follow.

What is claimed is:

1. A spray bottle for holding and dispensing a liquid, comprising:

a container having a continuous volume for holding the liquid, the container having a bottom forming the bottom-most portion of the spray bottle, the bottom being adapted to be collapsed into a substantially flat panel when empty and to be distended when the volume is filled with the liquid;

a spray head having a body and a feed tube extending from the body into the continuous volume adapted for dispensing and atomizing the liquid; and an elongated substantially rigid coupling extending about the feed tube intermediate the container and the spray head, the coupling having a sufficiently elongated shape to provide a hand hold between the body and the container.

2. The spray bottle of claim 1, wherein the spray head is releasably connected to the container.

3. The spray bottle of claim 1, wherein the spray head is releasably attached to an upper end of the coupling.

4. The spray bottle of claim 1, wherein the spray head is permanently attached to an upper end of the coupling.

5. The spray bottle of claim 4, wherein the spray head and the coupling are integrally formed as a unitary member.

6. The spray bottle of claim 1, wherein a lower end of the coupling is threadedly attached to the container.

7. The spray bottle of claim 6, wherein the container includes a substantially rigid fitting to which the lower end of the coupling is threadedly attached.

8. The spray bottle of claim 7, wherein the fitting is a canoe fitting permanently attached to the container by heat staking or an adhesive.

9. The spray bottle of claim 1, wherein the lower end of the coupling is permanently attached to the container by heat staking or an adhesive.

10. The spray bottle of claim 9, wherein the lower end of the coupling includes a canoe fitting.

11. The spray bottle of claim 1, wherein the coupling includes a tubular section having at least one of a circular cross-sectional portion and an elliptical cross-sectional portion.

12. The spray bottle of claim 1, wherein the coupling includes a relief pattern adapted to facilitate grip or enhance visual appearance.

13. The spray bottle of claim 1, further including a decorative cover surrounding the coupling and extending from the spray head to the container.

14. The spray bottle of claim 1, further comprising a wrist strap secured to the spray head or the coupling.

15. The spray bottle of claim 1, further comprising a finger support secured to the spray head or the coupling and extending substantially perpendicular to the elongated coupling.

16. The spray bottle of claim 1, wherein the container is made from a plastic film or a laminate material.

17. The spray bottle of claim 16, wherein the container is made from the laminate material, which includes a printed film.

18. The spray bottle of claim 1, wherein the container is provided with at least one of a fashion element, a label, and printing.

19. The spray bottle of claim 1, wherein the container is generally rectangular and comprises at least two sheets of material joined together at peripheral edges.

20. The spray bottle of claim 19, wherein a bottom region of the container includes at least one gusset adapted to fold when the container is empty to permit the container to be collapsed into the flat panel, and to unfold when the container is filled with the liquid to permit the container to be distended.

21. The spray bottle of claim 20, wherein the bottom region of the container when distended is capable of supporting the spray bottle in an upright position on a substantially horizontal surface.

22. The spray bottle of claim 20, wherein a top region of the container includes at least one gusset that allows the container to be further distended when the container is filled with the liquid.

23. The spray bottle of claim 19, wherein the peripheral edges are joined together by heat sealing.

24. The spray bottle of claim 19, wherein the container includes at least one product display aperture.

25. The spray bottle of claim 24, wherein the at least one product display aperture is located in one of the peripheral edges of the container.

26. The spray bottle of claim 19, wherein the at least two sheets of material form side walls of the container, and wherein the container further comprises a third sheet of material that forms a bottom wall of the container, the third sheet of material having peripheral edges joined to the peripheral edges of the at least two sheets of material.

27. The spray bottle of claim 26, wherein the bottom wall of the container extends at an angle relative to a vertically extending feed tube terminating adjacent the bottom wall, thereby allowing more complete dispensing of the liquid from the container.

28. The spray bottle of claim 1, wherein the spray head is a trigger type sprayer.

29. The spray bottle of claim 1, wherein the container when collapsed into the flat panel has a width less than a width of the spray head, and wherein the container when distended has a width greater than the width of the spray head.

30. A spray bottle for holding and dispensing a liquid, comprising:

a container having a continuous volume for holding the liquid, the container having a bottom forming the bottom-most portion of the spray bottle, the bottom being adapted to be collapsed into a substantially flat panel when empty and to be distended when the bottle is filled with the liquid;

a spray head adapted for dispensing and atomizing the liquid; and an elongate coupling intermediate the container and the spray head, the coupling being substantially rigid and configured to provide a handhold.

31. The spray bottle of claim 30, wherein the spray head is releasably attached to the coupling.

32. The spray bottle of claim 30, wherein the spray head and the coupling are integrally formed as a unitary member.

33. The spray bottle of claim 30, wherein the coupling is releasably attached to the container.

34. The spray bottle of claim 30, wherein the coupling is permanently attached to the container.

35. The spray bottle of claim 30, wherein the container is made from a plastic film or a laminate material.

36. The spray bottle of claim 30, wherein the container is provided with at least one of a fashion element, a label, and printing.

37. The spray bottle of claim 30, wherein the container is generally rectangular and comprises at least two sheets of material joined together at peripheral edges.

38. The spray bottle of claim 37, wherein the container includes at least one gusset adapted to fold when the container is empty to permit the container to be collapsed into the flat panel, and to unfold when the container is filled with the liquid to permit the container to be distended.

39. The spray bottle of claim 30, wherein the spray head is a trigger type sprayer.

40. A retail display, comprising:

a plurality of spray bottles, each spray bottle including a container having a continuous volume for holding a liquid and a spray head connected to the container, the container having a bottom forming the bottom-most portion of the spray bottle, the bottom being adapted to be collapsed into a substantially flat panel when empty and to be distended when the bottle is filled with the liquid, the spray head being adapted for dispensing and atomizing the liquid;

an elongated substantially rigid coupling extending about the feed tube intermediate the container and the spray head, the coupling having a sufficiently elongated shape to provide a hand hold between the body and the container;

wherein the plurality of spray bottles are arranged in at least one row with the containers collapsed such that each spray head is in an abutting relationship with the spray head of at least one adjacent spray bottle.

41. The retail display of claim 40, wherein the container of each spray bottle includes at least one product display aperture from which the spray bottle is hung for display.

42. The retail display of claim 40, wherein the container of each spray bottle is provided with at least one of a fashion element, a label, and printing.

43. The retail display of claim 40, wherein the spray head of each spray bottle is a trigger type sprayer.

44. The retail display of claim 40, wherein each container when collapsed into the flat panel has a width less than a width of the associated spray head, and wherein each container when distended has a width greater than the width of the associated spray head.

45. The retail display of claim 40, wherein the containers in the at least one row are hung in a side by side relationship.

46. A hand-held spraying device for holding and dispensing a liquid, the device comprising:

a spray head including a body, a feed tube extending from the body, a trigger operably coupled to the body and a stem extending from the body;

a collapsible container having a continuous volume receiving the feed tube of the spray head, the container having a top and a bottom, wherein the bottom forms the bottom-most portion of the spray device and wherein at least the bottom is collapsible; and an elongate rigid neck extending intermediate the top of the container and the stem of the spray head, wherein the neck and the stem have a combined length sufficient to provide a hand hold between the body of the spray head and the top of the container.

47. The device of claim 46, wherein the neck is releasably coupled to the stem.

48. The device of claim 47, wherein the neck is releasably coupled to the container.

* * * * *